US006375049B1

(12) United States Patent
Geier

(10) Patent No.: US 6,375,049 B1
(45) Date of Patent: Apr. 23, 2002

(54) VALVE FOR RELEASING PRESSURIZED LIQUIDS

(75) Inventor: Adalberto Geier, Calceranica al Lago (IT)

(73) Assignee: Coster Tecnologie Speciali S.p.A., Calceranica al Lago (IT)

( * ) Notice: Subject to any disclaimer, the term of this patent is extended or adjusted under 35 U.S.C. 154(b) by 0 days.

(21) Appl. No.: 09/830,726

(22) PCT Filed: Oct. 28, 1999

(86) PCT No.: PCT/EP99/08197

§ 371 Date: Jul. 16, 2001

§ 102(e) Date: Jul. 16, 2001

(87) PCT Pub. No.: WO00/26116

PCT Pub. Date: May 11, 2000

(51) Int. Cl.[7] ..... B65D 83/00

(52) U.S. Cl. ..... 222/402.1; 222/402.24; 222/402.25

(58) Field of Search ..... 222/402.1, 402.2, 222/402.24, 402.25

(56) References Cited

U.S. PATENT DOCUMENTS 3,598,292 A * 8/1971 Killany ..... 222/402.1
3,669,316 A * 6/1972 Corsette ..... 222/402.24
5,690,256 A * 11/1997 Smith ..... 222/402.1
5,938,085 A * 8/1999 Conroy et al. ..... 222/402.2
6,070,770 A * 6/2000 Tada et al. ..... 222/402.25
6,152,335 A * 11/2000 Stern et al. ..... 222/402.25

* cited by examiner

*Primary Examiner*—Philippe Derakshani
*Assistant Examiner*—Thach H. Bui
(74) *Attorney, Agent, or Firm*—Andrus, Sceales, Starke & Sawall

(57) ABSTRACT

A valve for dispensing pressurized fluids, foams, gels or the like is described, with a valve body (15) that can be fixed in a fluid-tight manner at the edge of a lid aperture within a lid for a container opening, a delivery tube (13) that is mounted in the valve body (15) so as to be axially displaceable and movable out of a closed position against the action of an elastic element, and wherein the fluid connection to the discharge channel (25) of the delivery tube (13) is provided by a passageway (24) formed in the delivery tube and opening into the discharge channel (25) at the end of the latter that is situated within the container, and wherein the outer edge (29) of the passageway (24) is so constructed as to be blunt, in particular is rounded.

5 Claims, 3 Drawing Sheets

VALVE FOR RELEASING PRESSURIZED LIQUIDS

DESCRIPTION

The invention relates to a valve for dispensing pressurized fluids according to the precharacterizing clause of claim 1.

The present case is concerned in particular with valves in an aerosol can. Apart from the contents and the container, the valve is the most important component of this sort of packaging: for the product to be usable at all times and in all circumstances, the valve must function perfectly. Even when the can has been stored for a relatively long time, the valve must deliver the product when first activated, faultlessly and in the predetermined spray pattern. Otherwise the entire package, including the contents, is useless.

Customarily valves designed for aerosol cans comprise a valve body, a delivery tube and a sealing ring. The valve body can be fixed in a fluid-tight manner to the edge of a lid aperture, disposed in a lid as an opening of the container. The delivery tube is disposed in the valve body so as to be axially displaceable and can be moved out of a closed position against the action of an elastic element, in particular a coiled compression spring. The sealing ring is situated between the edge of the lid aperture and the valve body, so that it encloses the delivery tube tightly. The sealing ring consists of a flexible sealing material, preferably rubber or the like. Within the delivery tube is a discharge channel with a lateral opening, in particular a bore, which in the closed position is blocked at its outer end by the sealing ring. When the delivery tube is pressed into the interior of the container, against the action of the elastic element, the lateral opening or bore is freed from the sealing ring so that a pressurized medium within the container can escape to the exterior through the valve body, the lateral bore and the discharge channel of the delivery tube.

Figure 3:
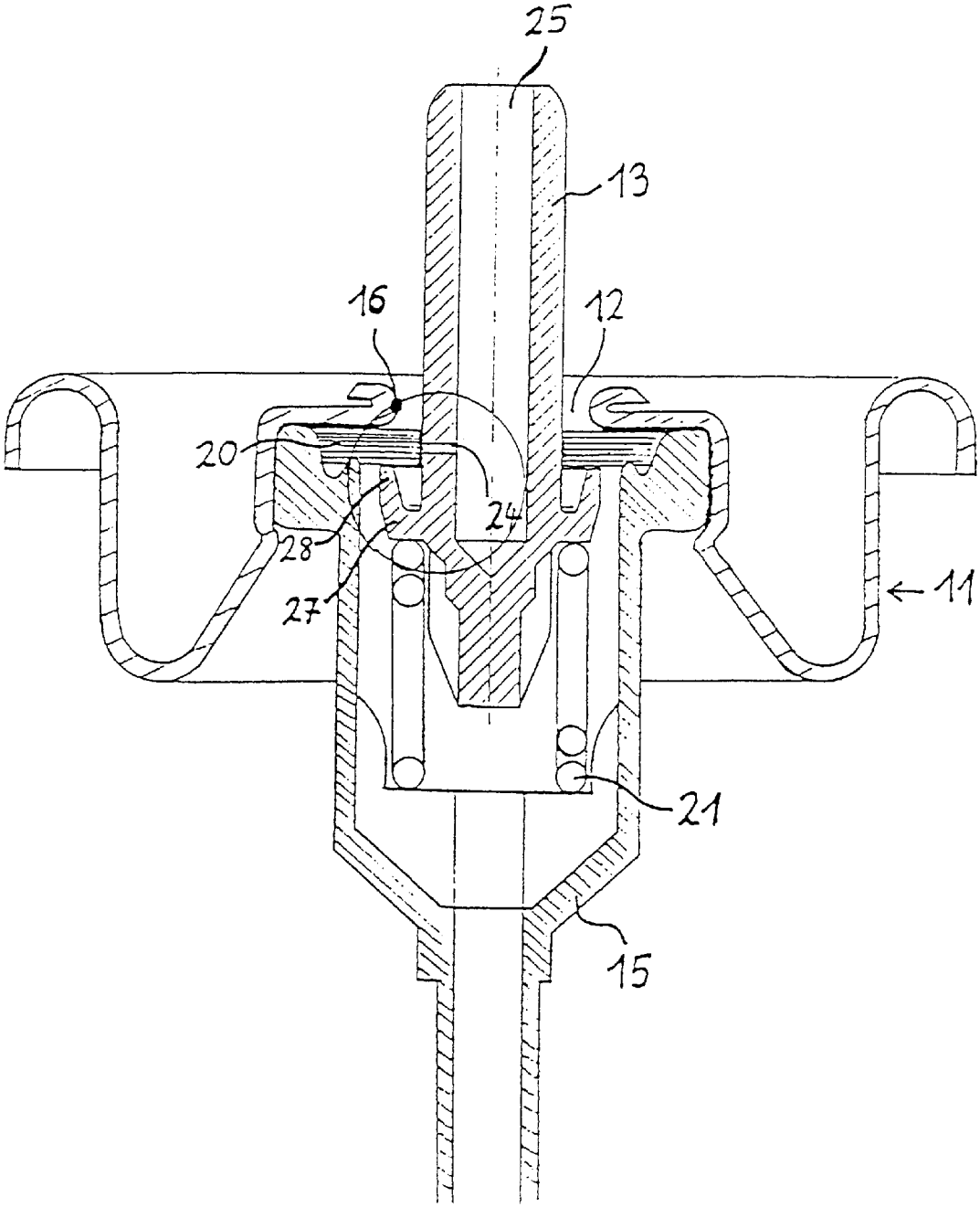

FIG. 3 shows a valve according to the state of the art, in longitudinal section. The valve is mounted on a lid 11, which can be used to close a corresponding opening of a container (not shown) for a pressurized medium. The lid 11 comprises a central aperture 12 to receive a delivery tube 13, which at its end towards the interior of the container extends into a valve body 15. The interior of the valve body 15 is in fluid communication with the interior of the container by way of an ascending pipe. The valve body 15 is fixed to the edge 16 of the lid aperture 12 in a fluid-tight manner. For this purpose the valve body 15 comprises a circumferential flange that extends radially outward, which in the assembled state overlaps an annular extension of the lid 11 that projects radially inward, so that the valve body 15 is clamped against the lid 11. Between the edge 16 of the lid aperture 12 and the circumferential flange of the valve body 15 a flat sealing ring 20 is disposed in such a way that it closely encloses the delivery tube 13. The sealing ring 20 consists of a flexible, corrosion-resistant material. The delivery tube 13 is mounted in the valve body 15 so that it is axially displaceable, and can be moved away from a closed position shown in FIG. 3 against the action of a coiled compression spring.

Within the delivery tube 13 is a discharge channel 25, which extends in the direction parallel to the median long axis of the tube 13 and is open to the exterior but closed at its inner end. A passageway 24 extending perpendicular to the discharge channel 25 connects the latter to the outer surface of the delivery tube at a level that is the same as the level of the sealing ring 20 when the apparatus is in the closed position. The sealing ring 20 thus blocks the outer opening of the passageway 24 in the closed position. When the delivery tube 13 is axially displaced into the interior of the container, the outer opening of the passageway 24 is moved into a position such that it is no longer blocked by the sealing ring 20. Thus a fluid connection is produced between the interior of the valve body 15 and the discharge channel 25.

The valve representing the state of the art shown in FIG. 3, however, has the disadvantage that when the delivery tube 13 is pressed inward, the elastic sealing ring 20 can be dragged along into the interior. The consequence is that the opening of the passageway 24 becomes freed from the sealing ring 20 later than expected. The delivery tube 13 must therefore be pressed relatively far down, i.e. into the interior of the container, in order to create the communication between the interior of the container and the discharge channel 25 by way of the passageway 24. As a result of the displacement of the seal and the sharp-edged construction of the passageway opening, the sealing material can become damaged and parts of it may even be cut off, which impairs the function of the valve and shortens its working life.

The subject matter of the German patent application P 198 26 308.2 filed by the same applicant (filing date Jun. 12, 1998) was proposed to eliminate the disadvantages of the state of the art described above, in that the passageway that opens into the discharge channel is formed by a slanted bore running from outside to inside to the interior of the container, so disposed that its outer opening is at least partially below the plane defined by the upper circumferential edge of the annular projection that extends towards the seal. As a result, the outer end of the passageway is at least not completely blocked by the sealing ring. The fluid communication between discharge channel and container is created as soon as the annular flange becomes separated only slightly from the sealing ring. This occurs suddenly when the delivery tube is depressed by only a small distance.

But as long as the outer end of the passageway is blocked at least partially, even though not completely, by the sealing ring, the problems described above (dragging the ring along and damage to the sealing material) cannot be entirely eliminated.

An advantageous embodiment of P 198 26 308.2 provides for the outer opening of the slanted bore to be situated below the plane defined by the upper circumferential edge of the annular projection extending towards the sealing ring. However, this embodiment demands precise machining and fitting of the valve into the lid of the aerosol container; furthermore, in this case because the outer opening of the passageway is always unblocked, the annular projection must always abut precisely against the sealing ring, and even a slight, unintentional axial displacement of the delivery tube can cause an undesired discharge.

The objective of the present invention is to provide a valve for dispensing pressurized fluids with which the problems presented above can be largely avoided, and with which closely reproducible dosages can be reliably delivered.

This objective is achieved by the present invention.

The subject matter of the invention is a valve according to Claim 1 to dispense pressurized fluids, foams, gels or the like, with a valve body that can be fixed in a fluid-tight manner at the edge of a lid aperture within a lid for a container opening, a delivery tube that is mounted in the valve body so as to be axially displaceable and movable out of a closed position against the action of an elastic element, in particular a coiled compression spring, and a sealing ring made of rubber or similar flexible sealing material and disposed between the edge of the lid aperture and the valve body so that it closely encloses the delivery tube. The arrangement is such that when the delivery tube or valve is in the closed position, the sealing ring blocks a discharge channel formed within the delivery tube in a fluid-tight manner. The delivery tube here comprises an annular flange with an annular projection extending towards the sealing ring to produce a fluid seal between sealing ring and discharge channel in the delivery tube, such that the fluid connection to the discharge channel of the delivery tube is formed by a passageway situated in the delivery tube and opening into the discharge channel at the end of the latter that is situated within the container. The outer edge of the passageway is so constructed as to be blunt, in particular is rounded.

Advantageous embodiments are the subject matter of the subordinate claims 2 to 4.

Figure 1B:
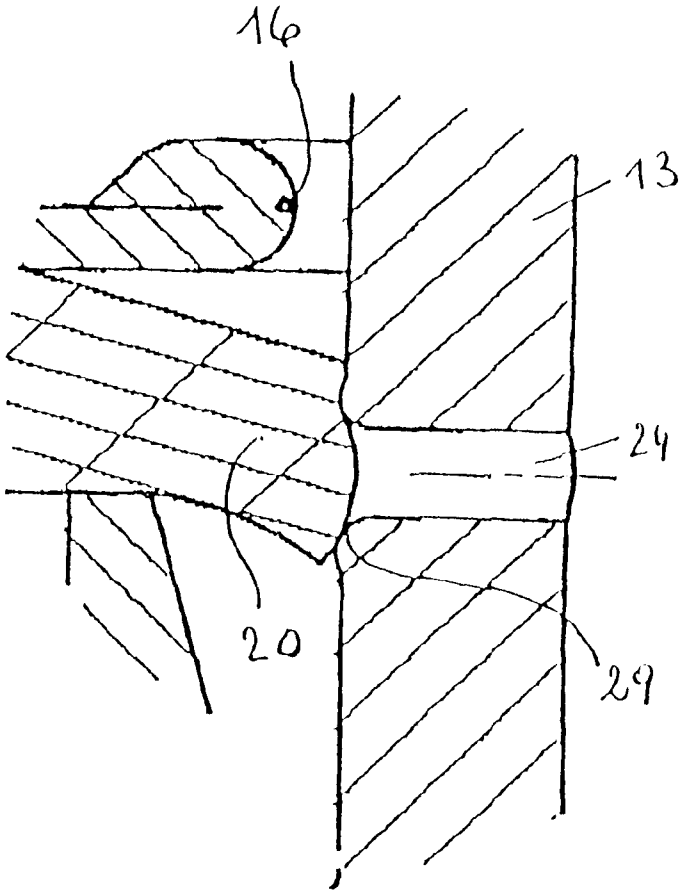
Figure 1A:
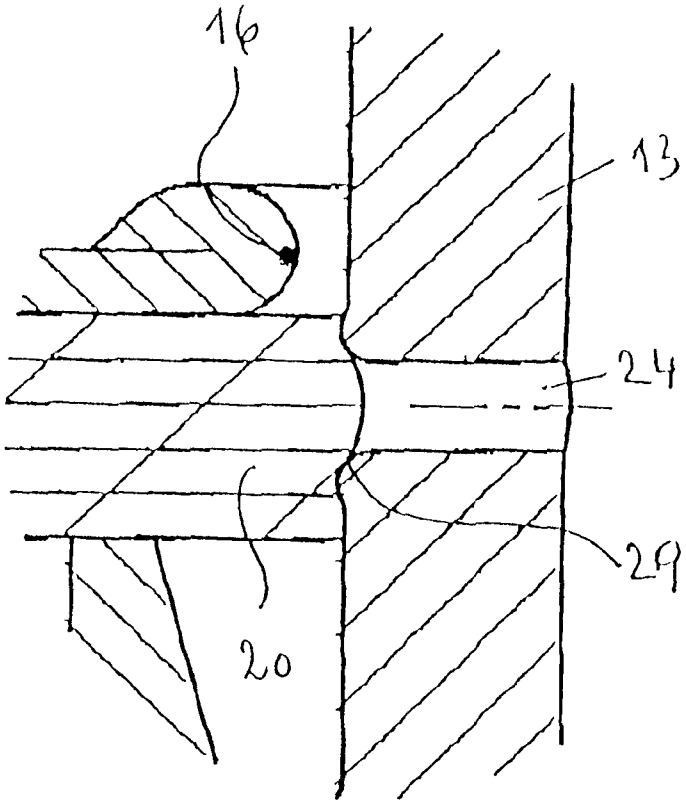
Figure 2B:
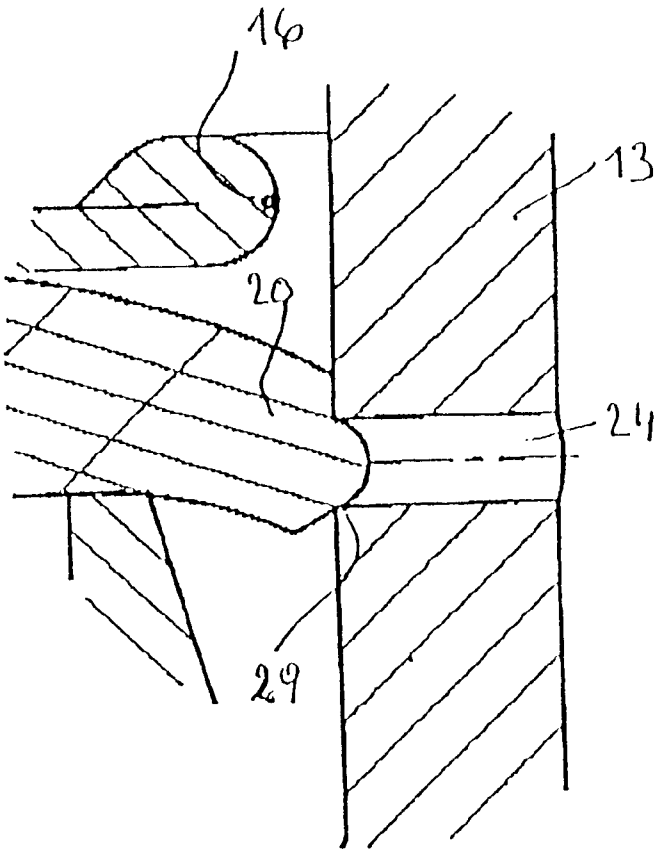
Figure 2A:
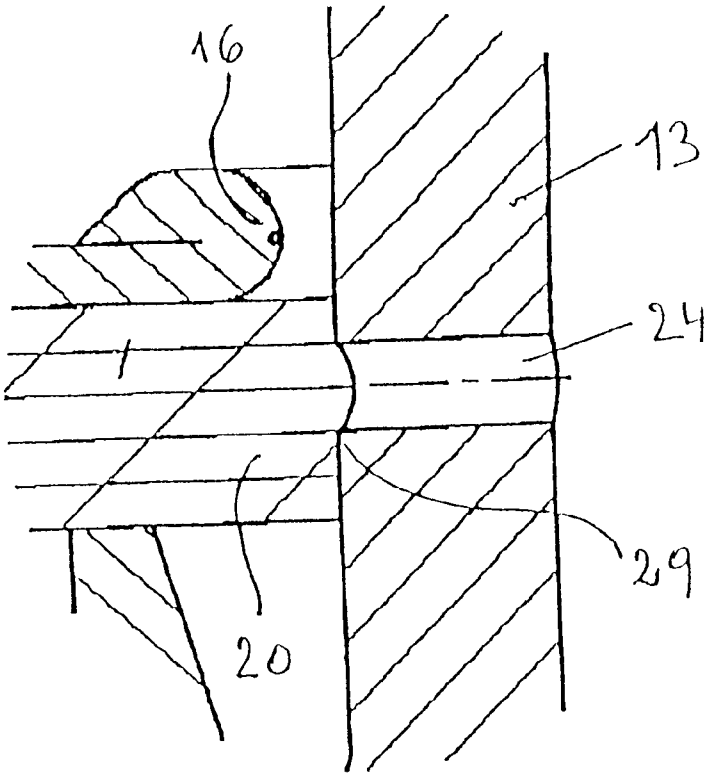

In the following, embodiments of valves representing the state of the art and of valves in accordance with the invention are described in detail with reference to the attached drawings, wherein FIG. 1 is an enlarged drawing of the circled region in FIG. 3, with a passageway in accordance with the invention, as it appears when the valve is closed (FIG. 1*a*) and when it is in the process of opening (FIG. 1*b*);

FIG. 2 is an enlarged drawing of the circled region in FIG. 3, with a passageway according to the state of the art, as it appears when the valve is closed (FIG. 2*a*) and when it is in the process of opening (FIG. 2*b*); and FIG. 3 shows a valve according to the state of the art and according to the precharacterizing clause of claim 1, in longitudinal section.

In FIGS. 1 and 2, the reference numerals that are the same as those in FIG. 3 have the same meaning as those in FIG. 3.

FIG. 2 makes clear that when the edge 29 of the opening of the passageway 24 is not blunted but rather is substantially sharp, during the process of opening the valve there is a pronounced tendency for the seal 20 to be dragged along and squashed.

In FIG. 1, because of the blunted (rounded) shape of the edge 29 of the opening, hardly any dragging and squashing of the seal 20 can be discerned. As a result, good functioning of the valve is ensured and destruction of the sealing material can be avoided.

The cross section of the blunted edge of the outer opening of the passageway 24 can have any shape that avoids a sharp contour. For instance, it can be rounded (preferably with a slight protrusion, as shown in FIG. 1), bevelled or trumpet-shaped.

The passageway 24 shaped according to the invention can be constructed, for instance after manufacture of the delivery tube 13 (which as a rule is made of a suitable plastic), in a simple manner by means, e.g., of a heated needle, a drill or similar suitable tools.

The passageways usually have a diameter of 0.25 to 1.0 mm, preferably 0.27 to 0.5 mm, and a length of 1.0 to 4.0 mm.

The radius of a circle matched to the curvature with which the outer edge is blunted, e.g. the radius of a slight, rounded protrusion, is preferably in the range from ⅓ to ½ of the diameter of the passageway 24.

Because of the good function that is achievable with the configuration of the outer edge in accordance with the invention, the passageway can be constructed as a transverse bore (parallel to the cross-sectional plane of the sealing ring) or as a slanted bore (which extends from outside to inside and from an upper to a lower level), and the outer opening can be situated in the region of the sealing ring or partially below the plane defined by the upper circumferential edge of the annular projection directed toward the sealing ring.

All the characteristics disclosed in the application documents are claimed as essential to the invention insofar as they are new to the state of the art individually or in combination.

LIST OF REFERENCE NUMERALS

11 Lid
12 Central aperture
13 Delivery tube
15 Valve body
16 Edge
20 Sealing ring
24 Passageway
25 Discharge channel
27 Annular flange
28 Annular projection
29 Edge of the passageway opening

What is claimed is:

1. Valve for dispensing pressurized fluids, foams, gels, with a valve body that can be fixed in a fluid-tight manner at the edge of a lid aperture within a lid for a container opening, a delivery tube that is mounted in the valve body so as to be axially displaceable and movable out of a closed position against the action of an elastic element, in particular a coiled compression spring, and a sealing ring made of rubber or similar flexible sealing material and disposed between the edge of the lid aperture and the valve body so as to closely enclose the delivery tube in such a way that when the delivery tube or valve is in the closed position, the sealing ring blocks in a fluid-tight manner a discharge channel formed within the delivery tube, wherein the delivery tube comprises an annular flange with an annular projection extending towards the sealing ring to produce a fluid seal between sealing ring and discharge channel in the delivery tube, and wherein the fluid connection to the discharge channel of the delivery tube is provided by a passageway having an outer edge formed in the delivery tube and an opening into the discharge channel at the end of the latter that is situated within the container, the improvement wherein said outer edge of the passageway is rounded to form a blunt edge.

2. The valve according to claim 1, wherein said the passageway (24) is constructed as a transverse bore.

3. Valve according to claim 1, characterized in that the outer edge (29) of the passageway (24) has a founded, slightly protruding form.

4. The valve according to claim 1, characterized in that the outer edge has a radius equal to ⅓ to ½ of the diameter of the outer edge (29) of the passageway (24).

5. The valve of claim 1, wherein said passageway (24) is constructed as a slanted bore.

* * * * *